US006155605A

United States Patent [19]

Bratchley et al.

[11] Patent Number: 6,155,605

[45] Date of Patent: Dec. 5, 2000

[54] DOCUMENT OF VALUE

[75] Inventors: Robin Bratchley, Reading; Andrew Nutton, Hampshire; Malcolm Robert Murray Knight, Hampshire; Duncan Hamilton Reid, Hampshire, all of United Kingdom

[73] Assignee: De la Rue International Limited, London, United Kingdom

[21] Appl. No.: 09/155,080

[22] PCT Filed: Apr. 14, 1997

[86] PCT No.: PCT/GB97/01022

§ 371 Date: Oct. 16, 1998

§ 102(e) Date: Oct. 16, 1998

[87] PCT Pub. No.: WO97/39428

PCT Pub. Date: Oct. 23, 1997

[30] Foreign Application Priority Data

Apr. 15, 1996 [GB] United Kingdom ..... 9607788

[51] Int. Cl.[7] ..... B42D 15/00

[52] U.S. Cl. ..... 283/72; 283/93; 283/91; 283/57; 283/83; 354/2

[58] Field of Search ..... 283/83, 82, 72, 283/87, 91, 93, 901, 902, 67, 70, 57, 58, 59; 359/567, 572, 2, 566

[56] References Cited

U.S. PATENT DOCUMENTS

| | | | |
|---|---|---|---|
| 4,114,804 | 9/1978 | Jones et al. . | |
| 4,446,204 | 5/1984 | Kaule et al. . | |
| 4,609,207 | 9/1986 | Muck et al. . | |
| 5,005,873 | 4/1991 | West . | |
| 5,142,383 | 8/1992 | Mallik | 283/91 X |
| 5,447,335 | 9/1995 | Haslop | 283/91 |
| 5,912,767 | 6/1999 | Lee | 283/91 X |

FOREIGN PATENT DOCUMENTS

| | | |
|---|---|---|
| 0 059 056 A1 | 9/1982 | European Pat. Off. . |
| 0 319 525 A2 | 6/1989 | European Pat. Off. . |
| 0 340 898 A2 | 11/1989 | European Pat. Off. . |
| 0 522 217 A1 | 1/1993 | European Pat. Off. . |
| 0 610 917 A1 | 8/1994 | European Pat. Off. . |
| 1 439 173 | 6/1976 | United Kingdom . |
| 1 585 533 | 3/1981 | United Kingdom . |
| WO 89/07804 | 8/1989 | WIPO . |

*Primary Examiner*—Willmon Fridie, Jr.
*Attorney, Agent, or Firm*—Oliff & Berridge, PLC

[57] ABSTRACT

A document of value such as a banknote comprises a substrate having a security feature in or on one region of the substrate. The security feature has at least one machine authenticatable high security entity (HSE) and at least one further machine authenticatable entity comprising a low security entity (LSE) or a high security entity, the at least two entites providing different detectable characteristics. The or each HSE is an homogeneous mixture of at least two components exhibiting different detectable characteristics, and the LSE is a single component exhibiting a detectable characteristic different from those exhibited by the HSE.

26 Claims, 1 Drawing Sheet

DOCUMENT OF VALUE

BACKGROUND OF THE INVENTION

1. Field of the Invention

The invention relates to a document of value and a method of authenticating such a document, and methods and apparatus for sorting documents of value.

2. Description of Related Art

In order to detect counterfeits of documents of value, it is conventional to apply security features to such documents which can then be detected during an inspection or authentication process.

Machine readable security features are well known for use with currency and other documents of value. They are provided for detection by portable detectors, portable hand held units, teller assist and retail assist equipment to ascertain the genuine nature of banknote and documents of value. Additionally they are used for machine checking the integrity of banknotes or other security documents on counting machines or sorting machines. The latter can pass documents at linear speeds of 1 m/s or more. Other areas where banknotes and other documents of value are machine read include note accepting devices, e.g. for car parks, note recyclers, vending machines and gaming machines.

Typical techniques to determine authenticity involve measurement of specific properties of materials. Examples of characteristics that are used in this way are Fluorescence, Magnetism, Phosphorescence, Absorption of light (uv, visible, ir) and Electrical Conductivity.

These features may be typically printed on to the document in either a visible ink, or an ink which cannot easily be seen. Alternatively detectable security features have been part of the substrate being incorporated into the security thread or in the paper itself.

Luminescent features are detected by exposing with a certain wavelength of light, typically in the uv or visible, and analysing the emitted light at one or more wavelengths in the visible or infra red. Both phosphorescent and fluorescent materials have been employed. In the case of phosphorescent materials, measurement of decay characteristics may also be carried out. Mixtures of phosphors and fluophors have been employed in detection.

Materials are known which can be excited by visible light and emit in the infra red, or alternatively emit in the red end of the spectrum after excitation in the visible. Anti-Stokes materials can be excited in the ir and emit in the visible.

Magnetic materials are commonly employed both in print and in paper features, e.g. threads. They have been sensed by measuring the remanent magnetisation after passing in the vicinity of a magnet. Alternatively, for added security, coercivity has been measured and in some instances the presence of a permanently magnetised code has been used.

Absorption of visible light can be used for pattern recognition, but more discriminating is absorption of uv or infra red light. Addition of special infra red absorbers to a component of the security document, such as the ink or thread has been carried out and the absorbance measured at one or more wavelengths.

Conductive materials are most effectively used on security threads or other plastic security components. Typically, a metallic conductive layer is used which is detected by capacitance or induction type detectors.

Security threads have also carried multilayer components of magnetic, fluorescent and metallic conductive layers.

Generally on a security document when different machine readable features are present, they are printed in different areas of the document and either form part of the design of the document or are invisible.

Bar codes are frequently used to add information such as the value, issuer or account code. These may be printed in the standard linear format, or as a two dimensional or checker board type format. In the case of clearing bank cheques, special alphanumerical fonts are used which are either read by optical character recognition or magnetic sensing. The E13B code is a commonly used format.

For security threads methods have been disclosed for encoding. For example a security thread with intermittent presence of magnetism is known as is a thread with a variation in the level of magnetism from point to point. Alternatively a method has been disclosed for encoding by using a sequence of magnetic materials of different coercivity.

GB-A-1585533 describes security documents which can be detected in more than one way. The invention discloses a device which comprises two distinct security features. One a magnetic layer, the other, either a luminescent material or a metal or an X-ray absorbant on a thread or other paper inclusion.

GB-A-1439173 describes a paper containing up to two fluorescent materials which may be in the same region of the document emitting in different spectral regions. Detection is carried out after dispersion at specific wavelengths.

U.S. Pat. No. 5,005,873 describes a document carrying two fluorescent materials which are excited at different wavelengths in the uv and have different emission spectra in the visible or uv and are detected by sequential illumination by light of different wavelengths. The fluophors are homogeneously dispersed in a plastics substrate or deposited in layers.

EP-A-0610917 describes an anti-counterfeit security device for documents which includes a combination of two security elements, one that is detectable by machine and a second which is visually detectable.

There are a number of drawbacks in the existing state of the art.

i) Where the detection method involves detection of a single component, security is limited and it is relatively easy for the knowledgeable counterfeiter to match the machine readable effect. Thus in the case of fluorescence, the counterfeiter can match the effect visible under uv light and obtain a simulation that could be picked up by a simple detector, which would register the note as genuine. A skillful counterfeiter is also able to match the machine readability response of magnetic and conductive features.

ii) A two layer structure on a thread, where each layer is made of a single machine readable component, can also be analysed by the skilled counterfeiter and replicated. The weakness being that physical examination of the document will reveal the nature of the construction.

iii) Bar codes in themselves do not give added security unless they can be completely hidden. Thus magnetic code lines on cheques and travellers cheques have been counterfeited. Even if such codes are hidden they can generally be picked up by simple detectors on the market, or by dissection of the feature and can be replicated.

iv) Mixtures of materials give improved protection because equipment that is not generally available to the public is needed to unravel the key detection properties. However, the detection of such materials requires the use of more complex measuring equipment and cannot easily be used in detectors which are fitted to lower cost machines, such as counters or point of sale equipment owing to cost and size constraints. For a similar reason, some more esoteric scientific properties, which can and are employed at high cost in central banks, are not appropriate for use at point of sale, counters or vending machines etc.

V) On existing documents, machine readable features have been largely located in different areas of a document to make use of low and higher level detection. This however is becoming increasingly more difficult to achieve as the space available on a printed document is limited. The presence of a larger number of machine readable areas can significantly affect the visible appearance of documents and is undesirable due to either the direct or indirect requirements of the machine readable area.

SUMMARY OF THE INVENTION

In accordance with one aspect of the present invention, a document of value comprises a substrate having a security feature in or on one region of the substrate, the security feature having at least one machine authenticatable high security entity (HSE) and at least one further machine authenticatable entity comprising a low security entity (LSE) or a high security entity, the at least two entities providing different detectable characteristics, wherein the or each HSE is an homogeneous mixture of at least two components exhibiting different detectable characteristics, and the LSE is a single component exhibiting a detectable characteristic different from those exhibited by the HSE.

BRIEF DESCRIPTION OF THE DRAWINGS

Exemplary embodiments of the invention will be described with reference to the accompanying drawings, in which.

DETAILED DESCRIPTION OF PREFERRED EMBODIMENTS

Figure 1:
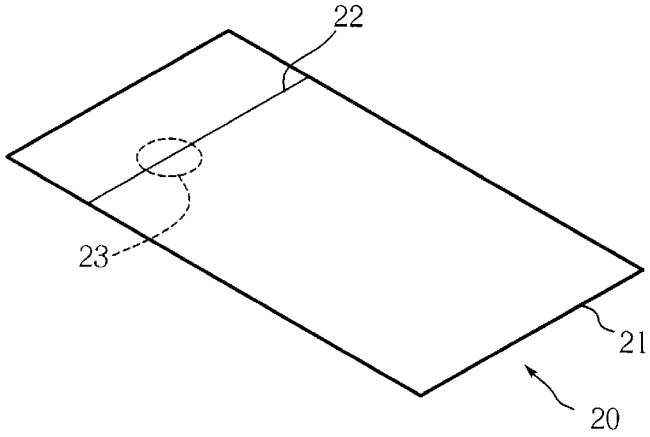
FIG. 1 illustrates a banknote according to this invention.
Figure 2:
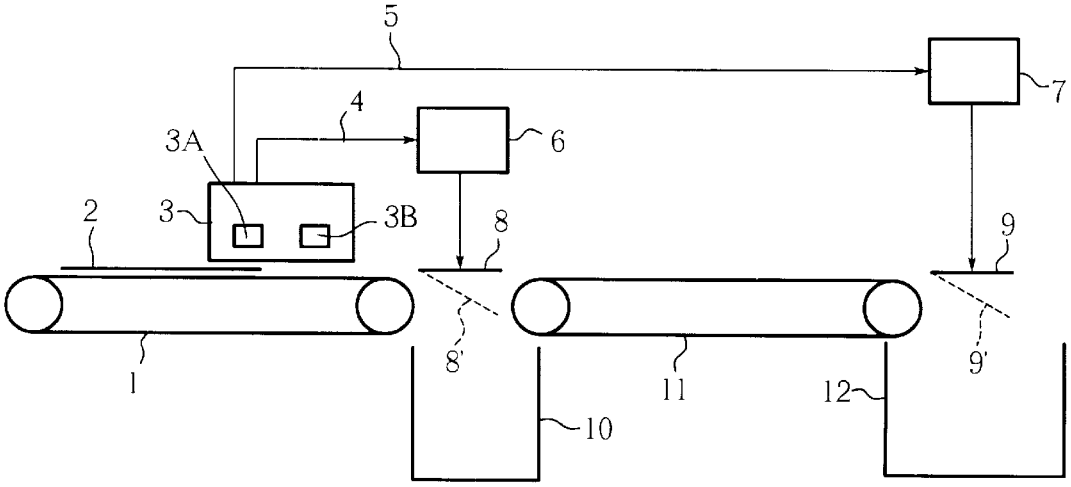
FIG. 2 illustrates a sorting apparatus according to this invention.

This invention has a number of significant advantages over the prior art. Firstly, by locating the security feature in one region of the substrate, this will make it much easier to locate the security feature in the machine authentication applications envisaged. The present invention combines the benefits of a simple detection system that can be used at low cost in equipment where there is little machine space and which could not justify higher space, with the benefits of a high level feature which requires more in-depth interrogation and can be used on more sophisticated sorters.

Secondly the invention provides clearly separate entities. Preferably, these are high security and low security entities (preferably in separate layers) which can be utilised in different situations depending upon the certainty of authentication which is required. Thus, the LSE can be utilised in applications where a simple detector is used, for example retail outlets and the like, while the HSE (or HSE and LSE) can be used in much higher security applications, for example in commercial banks or central banks. In other cases, however, the entities can be defined by two HSEs.

Typically, the LSE will be a single material which can be detected so as to provide a YES/NO response indicating the presence or absence respectively of the detectable characteristic. The HSE will typically include detectable characteristics which are relatively difficult to detect allowing an in-depth interrogation of the document and a much higher level of authentication.

As the HSE is an homogeneous mixture of at least two components, it is much more difficult to analyse and thus difficult to counterfeit on a simple trial and error basis. This should be contrasted with the more basic security elements described in EP-A-0610917.

Furthermore, at a minimum, there will be at least three different detectable characteristics present on the document, which will significantly improve the security of the document. Thus, although it is not necessary to determine the presence of all the detectable characteristics on the document, the more that are detected the greater the level of security achieved.

The area of the document within which the feature will be interrogated is preferably less than 1600 $mm^2$ or more preferably 400 $mm^2$ or less. Areas down to 10 $mm^2$ or less are possible which is particularly useful if the feature is incorporated in a security thread.

The two entities may comprise continuous layers or a mixture of continuous and discontinuous layers. For example, one or both may have a dot structure or consist of broken images. The layers may spread away from the region of the security feature.

The two entities may be provided side by side in the region and in this respect could define a bar code type of structure. In particular, the two entities may be laterally interleaved so that each defines its own bar code structure. Other types of interleaving leading to a chequer board pattern or mosaic are also possible.

In other examples, the two entities overlie one another. In these examples, it is important that the overlying layer does not affect the readability of the underlying layer. Thus, for example, where one of the layers includes a magnetic characteristic, this should be placed beneath any layer having an invisible fluorescence. Alternatively, the layers could be discontinuous as described above.

The two entities may be incorporated in or on the document substrate in a variety of ways. For example, if the document includes a security thread in the region of the security feature, then the feature could be provided on the security thread, or one of the two entities could be incorporated in the security thread itself. When one or more layers are provided on the security thread, these can be applied for example by gravure coating. Alternatively, broken or discontinuous layers may be applied as described earlier. The thread may be a polymeric or other type of security thread which may or may not be isotropic. In some cases, one or both of the two entities could be sandwiched between one or more layers of the thread material or alternatively be within the body of the thread material.

In other examples, one of the two entities is incorporated into the substrate itself. This would be achieved during manufacture of the substrate with the one of the two entities being in the form of a planchette, fibres, metallic fibres, dye or pigment particles.

In some cases, at least one of the two entities is printed on the substrate. Typical printing processes are lithography, intaglio, gravure, screen, flexography, and letterpress printing.

One or both of the two entities may be part of a coating applied during substrate (paper) manufacture, or after production of the substrate. Alternatively, they could consist of a combination of several different components. Thus the different components may consist of the substrate, possibly a coating, printed matter which could be litho, letterpress intaglio screen, or other printing process. It may also have a foil or hologram attached in some way, for example by foil blocking. A coating may also be vacuum deposited. The substrate could be paper or plastics based. The substrate may contain or include other security elements such as a security thread, planchettes, fibres, metallic fibres, dye or pigment particles or other security elements.

The entities may be part of a coating applied during paper manufacture or after production of the paper. Alternatively, as part of an applied hologram, kinegram, diffractive device, colour play or optically variable device. These components may themselves per se be a machine authenticatable entity to which the HSE is added. The HSE and LSE could be added to foil such as described in EP 522217.

In general, the two entities may be provided by a combination of paper (substrate) and print entities, paper and thread entities, or a combination of paper, thread and print entities. Moreover, a hologram can be part of the security feature involving paper substrate or print. One example would be where a foil structure is not continuous and contains holes through which the print or paper entity could be monitored as well.

Although bar codes in themselves do not form the essential component of this invention, they can be incorporated as part of it. Thus the elements of bar codes or related codes may be read in the ir, by uv (fluo or phosphorescence), uv absorption or magnetic effects. The bar code will form just one element of this invention. It will either carry the LSE or HSE.

Combinations of intaglio or other printed lines have also been used as a detection device using the effect of pattern and/or relief, on light, as in intaglio sensing and recognition devices. This type of feature can also form one element of the invention.

The homogeneous HSE can have a range of different compositions.

For inks and coatings, the homogeneous mixture may be produced by intimately mixing a finely divided pigment with a vehicle, preferably but not essentially with a particle size of less than 10 microns, even more preferably with a particle size less than 5 micron and even more preferably with a particle size less than 1 micron. The ink vehicle could be for example an autoxidisable alkyd modified drying oil system as used in litho, letterpress or intaglio ink systems.

Alternatively, any other ink or coating system that is known to the art may be used to carry the machine readable components.

Alternatively, the HSE may be applied by vacuum coating, sputtering or other related techniques, or solidification of melt. It could be in a glass type of composition (in its broadest meaning) or alternatively as a solid solution on a vehicle, such as a dyestuff in a polymeric plastic carrier or vehicle.

Where the HSE is in the (paper) substrate, this will be included by intimately mixing the components in the stock during preparation of the paper.

The HSE may be a plastics component which carries dispersed in it, or in solid solution, the machine readable components.

The HSE and LSE may contain a variety of types of materials which have machine readable properties. Examples are luminescence, light absorption (e.g. visible, ir, uv), Raman activity, magnetism, microwave interaction, x-ray interaction and conductivity. In some cases, the detectable characteristics of the two entities are different properties of the same type, for example different wavelengths of luminescence.

Typical materials that can be used within the HSE are described below. The homogeneous entity may consist of a mixture of materials of a specific type (e.g. as described in each section below), but they may be composed of mixtures of materials with different classes of physiochemical properties (e.g. materials taken from different sections below).

(i) Luminescent Materials

By way of example luminescent materials that can be included in the homogeneous layer are shown in Table 1 below.

Coatings, inks and plastics may be formulated with specific combinations of these materials to produce inks which may be interrogated in a variety of ways.

At least two luminescent materials would be included in a formulation. Examples of such formulations are given in Table 2 below.

The design of the detector system will take into account at least two of the properties, or one of these properties in combination with a different type of property as described in other sections. These are:

excitation growth characteristics excitation wavelength emission decay characteristics emission wavelength temperature of the measurement angular variation with viewing.

This is achieved in the design of the detector and the algorithm allowed for analysing the signals. Detection can be carried by using a flash lamp, pulsed source or illuminating at a different location along the track of the document on the banknote handling machine.

ii) Magnetic Materials

Examples of magnetic materials that can be used in homogeneous mixtures are set out in Table 3 below.

The detector will take into account one or more of the following properties:

disturbance to magnetic field of which they are part.

remanent magnetic field produced by the materials after removal of the applied magnetic field.

the coercivity of the material.

temperature dependence of the magnetic property.

rate at which the magnetic property can change with a change in applied field strength.

magnetic permeability.

Mixtures of magnetic materials in a homogeneous format can be used that can modify the type of field produced.

The detected material may also comprise iron/cobalt alloys, and other soft magnetic materials with low coercivity and remanence.

Mixtures of magnetic components can be used to produce effects that would not be produced by a single material.

Typical mixtures of magnetic materials that have been prepared are:

Formula 1

| | |
|---|---|
| $\gamma$-$Fe_2O_3$ | 20% |
| Co—$Fe_2O_3$ | 20% |
| Vehicle | 60% |

Formula 2

| | |
|---|---|
| $\gamma$-$Fe_2O_3$ | 20% |
| Co—$Fe_3O_4$ on $Fe_2O_3$ | 20% |
| Vehicle | 60% |

Formula 3

| | |
|---|---|
| Co—$Fe_3O_4$ on $Fe_2O_3$ | 20% |
| BaO—$6Fe_2O_3$ | 20% |
| Vehicle | 60% |

Formula 4

| | |
|---|---|
| $\gamma$-$Fe_2O_3$ | 13.3% |
| Co - $\gamma$-$Fe_2O_3$ | 13.3% |
| Ba0—$6Fe_2O_3$ | 13.3% |
| Vehicle | 60.1% |

Formula 5

| | |
|---|---|
| $\gamma$-$Fe_2O_3$ | 10% |
| Ba0—$6Fe_2O_3$ | 30% |
| Vehicle | 60% |

Formula 6

| | |
|---|---|
| $\gamma$-$Fe_2o_3$ | 8% |
| Ba0—$6Fe_2O_3$ | 32% |
| Vehicle | 60% |

Vehicle may be letterpress formulation, litho, intaglio, gravure or screen.

iii) Mixtures of Fluorescent and Magnetic Materials

Formula 1

| | |
|---|---|
| Fluorescent Pigment | 5% |
| $Fe_3O_4$ | 25% |
| Vehicle | 70% |

Formula 2

| | |
|---|---|
| Fluorescent Pigment | 15% |
| $\gamma$-$Fe_2O_3$ | 25% |
| Vehicle | 60% |

Vehicle may be letterpress formulation, litho, intaglio, gravure or screen.

iv) Raman Materials

Typical Raman active material described in GB 2256433B may be used.

Typical formulae are:

| | |
|---|---|
| Polydiacetylene | 1–10% |
| Vehicle | 87–78% |
| Fluorescent pigment | 12% |
| Polydiacetylene | 1–5% |
| Vehicle | 62–58% |
| Fluorescent pigment | 12% |
| Pigment | 25% |

v) Ir Absorbers

Lightly coloured ir absorbers are available from ICI and are described in EP 0340898 A2 and related patents.

Mixtures of these materials may be used as one of the machine readable entities or as mixtures with other components.

The detectable characteristics of the HSE may comprise different characteristics such as luminescence and conductivity, or could comprise different properties of the same type, for example the presence of different luminescence wavelengths. Similarly, the characteristics of the HSE and LSE may be of different types or different properties of the same type.

Examples of LSEs include:

1. Phosphorescent Coating or Print (excite in uv emit in visible)

| | |
|---|---|
| Zinc Sulphide Phosphor | 5 to 60% |
| Vehicle | 95 to 40% |

2. Fluorescent Coating or Print (excite in uv emit in visible)

| | |
|---|---|
| Organic Fluorescent Compound | 1 to 40% |
| Vehicle | 99 to 60% |

3. Antistokes Coating (excite in ir emit in visible)

| | |
|---|---|
| Antistokes Compound | 1 to 60% |
| Vehicle | 99 to 40% |

4. IR Luminescent Coating or Print (excite in visible emit in ir)

| | |
|---|---|
| IR Luminescent Compound | 1 to 60% |
| Vehicle | 99 to 40% |

5. IR Absorbing Coating or Print

| | |
|---|---|
| Infra Red Absorber | 1 to 20% |
| Vehicle | 99 to 80% |

6. Conductive Metallic Coating
Vacuum Coated Aluminium on a Security Thread.

7. Magnetic Coating or Print

| | |
|---|---|
| Magnetic Compound | 5 to 60% |
| Vehicle | 95 to 40% |

8. UV Absorbing Coating or Print

| | |
|---|---|
| UV Absorber | 1 to 40% |
| Vehicle | 99 to 60% |

9. Metal Thread (detection by capacitance)
A polyester thread (12–23 micron thick) vacuum coated on one or two sides with aluminium to an optical density of 2.0 to 3.0 typically.

10. Magnetic Thread
Detection of remanent magnetism after passing through a magnetic field. A polyester thread (8–23 micron thick) coated on one side with a layer 5 micron thick of a magnetic pigment (e.g. $\gamma$ $Fe_2O_3$) in a polymeric binder.

11. Microwave Active Entities (detected by interaction with a microwave beam)
Dispersion of magnetic or non-magnetic microwave active fibres typically 6 micron in diameter and 5 mm long in paper. Randomly dispersed or in a band. Produced by known techniques.

In accordance with a second aspect of the present invention, a method of authenticating a document of value comprises providing a security feature in or on one region of a substrate of the document, the security feature having at least one machine authenticatable high security entity (HSE) and at least one further machine authenticatable entity comprising a low security entity (LSE) or a high security entity, the at least two entities providing different detectable characteristics, wherein the or each HSE is an homogeneous mixture of at least two components exhibiting different detectable characteristics, and the LSE is a single component exhibiting a detectable characteristic different from those exhibited by the HSE; optionally feeding the document of value past a detection system; detecting at least one of the detectable characteristics; and authenticating the document of value if the detected characteristic(s) satisfy predetermined conditions.

The predetermined conditions may include a pair of thresholds within which the detected characteristics, e.g. intensity or wavelength value, lie.

When the method is implemented at a low level, for example at a retail outlet or high street bank, usually only the characteristic of the LSE will be detected. However, at higher level sites, one or more of the characteristics of the HSE or HSE and LSE will be detected to determine whether or not the document is authentic.

We will now describe some specific examples.

EXAMPLE 1

A roll of polyester is vacuum-metallised with aluminium to a metal thickness of approximately 30 nm. A layer of magnetic material comprising organic binders and gamma ferric oxide particles is applied to the metal side of the film by a suitable coating technique, e.g. gravure, reverse roll etc. (Optionally, the magnetic coating is applied to the polyester side of the film). A second ply of vacuum-metallised polyester with the same metal thickness is laminated by known means to the first ply such that the second metal layer and the magnetic oxide are internal to the laminate. A coating comprising an organic binder and mixture of phosphor particles, e.g. of doped zinc sulphide and an additional material as is listed in section i) above is then applied over both surfaces of the laminate by known means, e.g. gravure, reverse roll etc. optionally, further organic protective coats and/or adhesives are applied over one or both sides of the phosphor coated laminate. The laminate is then mechanically reduced by known means to form security threads in the width range typically 0.5–4.0 mm. The security threads are then incorporated into banknote paper by known means to form a wholly embedded or partially windowed security thread e.g. using in the latter case the techniques disclosed in EP-A-0059056. The paper is then printed by known techniques and issued as banknotes.

In use, the authentication of the document comprises checks on three or more of the characteristics of the conductivity of the metal layers, the presence of the magnetic material by measurement of the remanent moment per unit area (equivalent to the remanent magnetisation-thickness product), the coercivity of the magnetic material, and the intensity/peak emission/band width/decay time of the phosphor material(s) when exposed to a suitable source of stimulating illumination using known detection techniques.

In this example, the LSE is provided by the layer of magnetic material, the low security level being achieved by determining the presence or absence of magnetic material. It will be noted, however, that higher security features can also be obtained from the magnetic layer including remanent moment and coercivity per unit area.

The HSE is defined by the coating providing a mixture of phosphor particles.

EXAMPLE 2

As Example 1, but the magnetic material is deposited in a non-continuous pattern along the length of the security thread such that the pattern forms a code which can be detected to increase the information from machine detection of the security device, and hence the reliability of the authentication process.

EXAMPLE 3

As Example 2, except that the irregular deposition of magnetic material is accompanied by variable thickness of magnetic material and hence signal strength during detection.

EXAMPLE 4

As Example 2 except that materials of different coercivities are deposited in different regions. A coercivity-based pattern is then generated of the different magnetic materials which is decoded.

EXAMPLE 5

As Example 1 except that an x-ray absorbent material, e.g. a barium salt, is included with the ferric oxide. The presence of the barium material is subsequently determined by an x-ray imaging system.

In accordance with a third aspect of the present invention, a method of sorting a set of documents having different values, a machine authenticatable identifying material being provided on or in each document, the identifying material having a physical property different from the form or shape or location of the material which identifies the document value, comprises feeding the documents past a detector to detect the physical property of the identifying material on each document; and feeding the documents to sorting means for sorting the documents in accordance with the detected physical properties.

In accordance with a fourth aspect of the present invention, apparatus for sorting a set of documents having different values, a machine authenticatable identifying material being provided on or in each document, the identifying material having a physical property different from the form or shape or location of the material which identifies the document value, comprises a detector for detecting the physical property of the identifying material; sorting means responsive to the output of the detector; and a feed system for feeding documents past the detector to the sorting means whereby the sorting means responds to the output of the detector to feed the documents to respective locations in accordance with their values as defined by the detected physical properties.

We have realised that it is possible to sort documents of value by making use of physical properties of an identifying material. Previous proposals have made use of magnetic bar codes and the like for providing authenticity and to some extent identifying documents but these codes could be determined by counterfeiters. In contrast, by utilising properties of the identifying material other than the formal location of the material significantly improves security.

Typically, the physical property cannot be detected by the naked eye.

FIG. 1 illustrates very schematically a banknote 20 having a paper substrate 21 in which is formed a thread 22. The banknote will carry conventional printing and the like (not shown).

A LSE is incorporated within the thread 22 by virtue of providing the thread as a polyester strip vacuum coated with aluminium.

The HSE comprises a combination of two luminescent materials of the kind previously described incorporated into the paper substrate 21 beneath the thread 22 in a region 23. It will be appreciated that many variations in the form of a security feature are possible as described above. For example, the luminescent materials making up the HSE could be located to one side of the thread 22. The LSE need not be located in a thread but provided separately.

The sorting apparatus comprises a first conveyor 1 for conveying banknotes 2 singularly to a detector system 3. Where a luminescent or phosphorescent feature is to be detected, the detector system 3 will include an irradiating source upstream of a detector. The source irradiates the banknote in the region expected to hold identification material (which in this case will luminesce) so that the material luminesces, the luminescence intensity and delay characteristics being detected by a first detector 3A. A detector 3B detects the presence of a magnetic material in the same area on a Y/N basis, and the detector system then determines the wavelengths of the luminescence and specific time delay and addresses this further with the Y/N magnetic information to a look-up table which defines the destination of a note carrying the magnetic feature and luminescence at each wavelength. The system 3 then generates a control signal on a line 4 or 5 depending upon the detected luminescence and magnetic response, the control signal being fed to a respective diverter control system 6,7 respectively. The control system 6 controls the position of a diverter 8 and the control system 7 controls the position of a diverter 9. If the banknote 2 being fed is identified as of the first denomination corresponding to a first luminescent wavelength then the diverter 8 is moved to the position 8' shown in dashed lines so that the note will drop into a store 10. Otherwise, the banknote 2 will pass over the diverter 8 to a conveyor 11 where it is conveyed to the diverter 9 which in turn can be moved to a position 9' allowing the note to drop into a store 12.

TABLE 1

| Luminophor | Activator |
|---|---|
| Yttrium Compounds | Rare Earth eg Eu, Nd, Tb |
| Gadolinium Oxide | Rare Earth eg Eu, Tb |
| Magnesium Germanium Oxide | Transitional Element eg Mn |
| Aluminium Oxide | Transitional Element eg Cr |
| Zinc Sulphine | Transitional Element eg Cu, Mn, Ag |
| Organic Fluorescent Compound | |

TABLE 3

| Magnetic Materials |
|---|
| Carbonyl Iron |
| Cubic/Octohedral/Spherical/Magnetite |
| Acicular Magnetite |
| Acicular Iron Oxide |
| Cobalt Modified Iron Oxide |
| Cobalt Modified Magnetite |
| Stabilised Iron |
| Metal Ferrites (eg Barium, Strontium) |
| Chromium Dioxide |
| Amorphous Magnetic/Metallic |

TABLE 2

| Zinc Sulphide Phosphor (1) | Zinc Sulphide Phosphor (2) | Rare Earth Phosphor (1) | Rare Earth Phosphor (2) | Fluorescent Compound | Vehicle |
|---|---|---|---|---|---|
| 1% to 60% | | 1% to 60% | | | 20%–98% |
| 1% to 60% | | 1% to 60% | | 1% to 60% | 20%–97% |
| 1% to 60% | 1% to 60% | 1% to 60% | | | 20%–97% |
| 1% to 60% | 1% to 60% | 1% to 60% | | 1% to 60% | 20%–96% |
| 1% to 60% | | 1% to 60% | 1% to 60% | | 20%–97% |
| 1% to 60% | | 1% to 60% | 1% to 60% | 1% to 60% | 20%–96% |
| 1% to 60% | 1% to 60% | 1% to 60% | 1% to 60% | | 20%–96% |
| 1% to 60% | 1% to 60% | 1% to 60% | 1% to 60% | 1% to 60% | 20%–95% |

What is claimed is:

1. A document of value comprising a substrate having a security feature in or on one region of the substrate, the security feature including at least one first machine authenticatable high security entity (HSE) and at least one second machine authenticatable entity comprising a low security entity (LSE) or a high security entity, the at least one first machine authenticatable high security entity and the at least one second machine authenticatable entity providing different detectable characteristics, wherein each high security entity is an homogeneous mixture of at least two components exhibiting different detectable characteristics, and the low security entity is a single component exhibiting a detectable characteristic different from the characteristics exhibited by the high security entity.

2. A document according to claim 1, wherein the at least one first machine authenticatable high security entity and the at least one second machine authenticatable entity are provided in different layers.

3. A document according to claim 2, wherein at least one of the at least one first machine authenticatable high security entity and the at least one second machine authenticatable entity comprise a continuous layer.

4. A document according to claim 1, wherein at least one of the at least one first machine authenticatable high security entity and the at least one second machine authenticatable entity comprise a dot or broken structure.

5. A document according to claim 1, wherein the at least one first machine authenticatable high security entity and the at least one second machine authenticatable entity are provided side by side.

6. A document according to claim 5, wherein the at least one first machine authenticatable high security entity and the at least one second machine authenticatable entity are laterally interleaved.

7. A document according to claim 1, wherein the at least one first machine authenticatable high security entity and the at least one second machine authenticatable entity overlie one another.

8. A document according to claim 1, the document including a security thread in the region of the security feature.

9. A document according to claim 8, wherein the security feature is provided on the security thread.

10. A document according to claim 8, wherein one of the at least one first machine authenticatable high security entity and the at least one second machine authenticatable entity is incorporated in the security thread.

11. A document according to claim 1, wherein one of the at least one first machine authenticatable high security entity and the at least one second machine authenticatable entity is incorporated into the substrate.

12. A document according to claim 11, wherein the one of the at least one first machine authenticatable high security entity and the at least one second machine authenticatable entity is in the form of planchettes, fibres, metallic fibres, a dye or pigment particles.

13. A document according to claim 1, wherein at least one of the at least one first machine authenticatable high security entity and the at least one second machine authenticatable entity is printed on the substrate.

14. A document according to claim 13, wherein the one of the at least one first machine authenticatable high security entity and the at least one second machine authenticatable entity is printed using one of lithography, letterpress, intaglio, gravure, screen, and letterpress printing.

15. A document according to claim 1, at least one high security entity is comprised of a homogeneous mixture of pigment particles and an ink vehicle.

16. A document according to claim 15, wherein the particle size is less than 10 microns.

17. A document according to claim 15, wherein the ink vehicle comprises an auto-oxidizable alkyd modified drying oil system.

18. A document according to claim 1, comprising at least one high security entity which is a molecular structure.

19. A document according to claim 1, wherein the detectable characteristics of at least one of the at least one first machine authenticatable high security entity and the at least one second machine authenticatable entity include one of luminescence, light absorbtion, Raman activity, magnetism, microwave interaction, x-ray interaction, and electrical conductivity.

20. A document according to claim 1, wherein the detectable characteristics of the at least one first machine authenticatable high security entity and the at least one second machine authenticatable entity are different properties of the same type.

21. A document according to claim 1 in which the interrogated area of the region of the security feature is less than 1600 $mm^2$, preferably 400 $mm^2$ or less.

22. A method of authenticating a document of value according to claim 1, the method comprising:

detecting at least one of the detectable characteristics; and authenticating the document of value if the at least one detected characteristic satisfy predetermined conditions.

23. A method according to claim 22, wherein one of the characteristics of the HSE is detected and used to authenticate the document.

24. A method according to claim 22, wherein at least two characteristics of the HSE are detected and used to authetic-ate the document.

25. A method according to claim 22, wherein the security feature comprises a HSE and a LSE, the detecting step comprising detecting the characteristic of the LSE only.

26. A method according to claim 22, further comprising feeding the document of value past a detection system which carries out the detection step.

* * * * *